United States Patent [19]

Hays

[11] 3,971,889

[45] July 27, 1976

[54] PORTABLE BAR ADAPTED FOR MOUNTING ELECTRONIC EQUIPMENT

[76] Inventor: Robert A. Hays, 717 SW. 6th, Apt. 18, Newport, Oreg. 97365

[22] Filed: Apr. 22, 1974

[21] Appl. No.: 462,613

[52] U.S. Cl. ..... 179/1 AT
[51] Int. Cl.[2] ..... H04R 27/00
[58] Field of Search ..... 190/42; 179/1 AT

[56] References Cited

UNITED STATES PATENTS

| | | | |
|---|---|---|---|
| 3,347,346 | 10/1967 | Young | 190/42 |
| 3,493,695 | 2/1970 | Stork | 179/107 R |
| 3,684,831 | 8/1972 | Fullmer | 179/1 AT |

*Primary Examiner*—Kathleen H. Claffy
*Assistant Examiner*—C. T. Bartz
*Attorney, Agent, or Firm*—Chernoff & Vilhauer

[57] ABSTRACT

A portable bar having compartments for mounting sound-producing and other types of electronic equipment. A normally upright case with a carrying handle has a hinged cover adapted for holding bar implements, an upper compartment for holding liquor and mixer bottles and a bottom compartment portion extending beneath the upper compartment adapted for holding multiple electronic devices such as a radio, cassette tape machine, calculator, batteries, etc. The bottom compartment portion is deeper than the upper compartment, thereby forming an L-shaped case, and has exposed upper and front surfaces when the case is opened for facilitating access to and control of the electronics. Speakers connected to the sound-producing electronic equipment fit removably into depressions on the exposed, protruding upper surface of the bottom compartment portion for storage, and have means for attaching to hangers at the top of the case and cover when removed from their stored positions. A narrow slotted compartment is preferably disposed between the top and bottom compartment portions for holding tape cassettes. The hinged cover mates with the L-shaped case in such a way that both the upper and bottom compartment portions are completely protected when the cover is closed.

7 Claims, 6 Drawing Figures

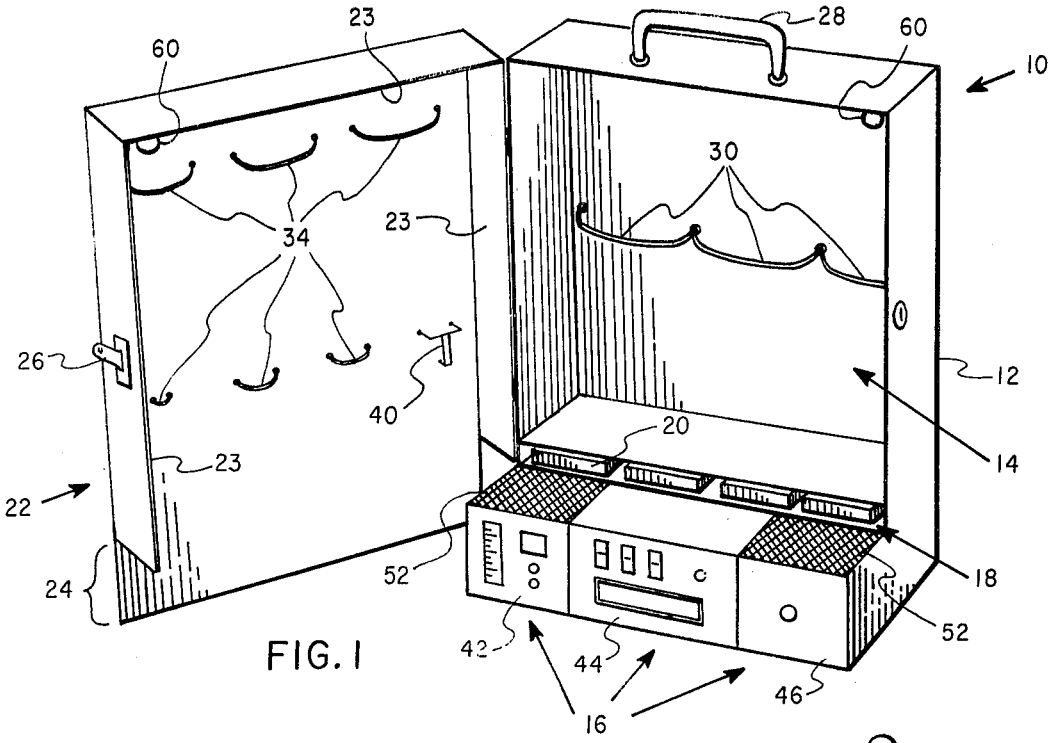
FIG. 1
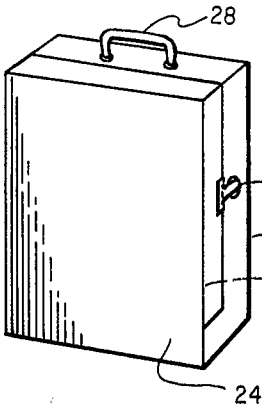
FIG. 2
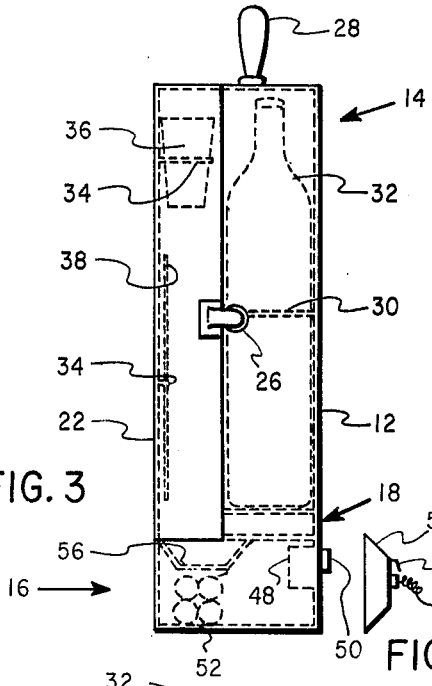
FIG. 3
FIG. 3a
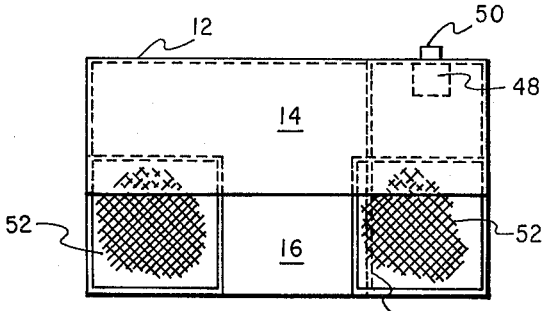
FIG. 5
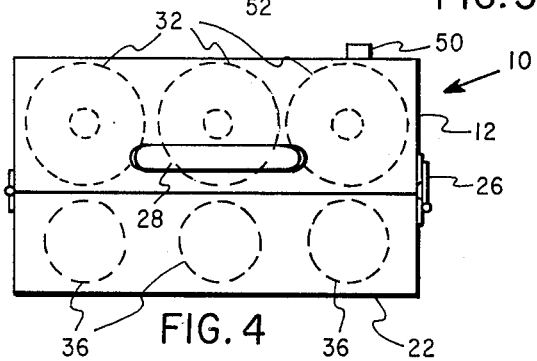
FIG. 4

PORTABLE BAR ADAPTED FOR MOUNTING ELECTRONIC EQUIPMENT

BACKGROUND OF THE INVENTION

This invention relates to portable bar apparatus having a unique arrangement of compartments for holding liquor and mixer bottles, bar implements and electronic equipment.

It has been recognized that people who travel for business or pleasure could make significant use of a relatively small carrying case for transporting beverages, bar implements and electronic devices, the latter comprising for example a stereophonic radio and tape player for entertainment and/or a dictaphone or calculator for business purposes. Moreover such a portable bar could be useful in an apartment where there is no room for a permanent installation but where it is desirable to keep bar implements and electronic equipment in one location for the common purpose of entertaining.

Young U.S. Pat. No. 3,347,346 discloses an attache case combining a portable bar facility with a work desk. However, this apparatus provides only the limited entertainment function of its bar facility and its structure is not adapted conveniently to mount electronic equipment. Hamilton U.S. Pat. No. 2,328,012 discloses an overnight case containing a radio. This apparatus also provides a limited entertainment function and its structure is not adapted to accept beverage bottles, bar implements or multiple modern electronic devices.

SUMMARY OF THE PRESENT INVENTION

The present invention provides a novel, stable portable bar adapted not only for holding the normal beverage bottles and bar implements but also adapted for conveniently mounting multiple modern electronic devices, so as to provide a highly compact multi-purpose entertainment or combination business-entertainment center. The bar comprises a normally upright carrying case having a handle and a hinged cover for covering the front of the case. The upper portion of the carrying case has a compartment for holding liquor bottles so that they may be carried and set upright, while the hinged cover is adapted to hold bar implements such as glasses, stirrers, etc. The bottom portion of the carrying case contains one or more compartments adapted for fixedly mounting the electronics, such compartments extending beneath the upper portion of the case and protruding forwardly therefrom so as to form an L-shaped case. The protruding bottom compartment portion has both front and top surfaces exposed and accessible when the cover is open, thereby providing multiple compartment surfaces for access to or control of the electronic devices. When the cover is closed, a panel depending from the cover shields the upper compartment and both the top and front of the bottom compartment portion, thereby protecting the electronics from breakage or tampering. Assuming that one of the electronic devices utilized is a tape player, (e.g. either a stereophonic tape machine or dictaphone) a narrow slot-like compartment preferably located between the upper and bottom compartment portions of the case is provided for storage of tape cassettes.

Part of the bottom compartment portion includes an area dedicated to the storage of batteries for portable operation of the electronic devices, electronic cords and a power supply for operating the electronics by means of current from a standard wall electric outlet. Other parts of the bottom compartment portion may contain other electronic devices for entertainment and/or business purposes, as desired. Since stereophonic music is a prominent dimension of audio entertainment, two depressions are preferably provided in the upper surface of the bottom compartment portion for storing a pair of stereo speakers. When the bar is in use the speakers are removed from these storage areas and may be placed on separate hangers at the top of the case and cover respectively to direct sound forwardly and provide stereo speaker separation. Placement of the electronics at the bottom of the portable bar is a significant expedient in that it facilitates their accessibility and increases the stability of the bar by lowering its center of gravity and maximizing the size of its base.

It is therefore a principal objective of the present invention to provide a novel portable bar having respective compartments adapted to carry beverage bottles and bar implements and to mount several alternative pieces of modern electronic equipment in a particularly useful and stable arrangement making efficient use of space and permitting easy access to and protection for the electronic devices.

It is a principal feature of the present invention to provide a normally upright L-shaped bar case having a compartment portion protruding forwardly from the bottom of the case adapted to accept and mount various electronic components.

It is another feature of the present invention to provide mating cover means for shielding the front and protruding top of the bottom compartment portion of the L-shaped case when the cover is closed.

It is another feature of the present invention to provide a storage space on the upper surface of the bottom compartment section of the case adapted to house a pair of stereophonic speakers.

It is yet another feature of the present invention to provide means for detachably hanging the speakers from the bar case and cover respectively when in use.

The foregoing and other objectives, features and advantages of the present invention will be more readily understood upon consideration of the following detailed description of the invention taken in conjunction with the accompanying drawings.

BRIEF DESCRIPTION OF THE DRAWINGS

FIG. 1 is a perspective view of the portable bar with its hinged cover open.

FIG. 2 is a perspective view of the bar with its hinged cover closed.

FIG. 3 is a side view of the bar.

FIG. 3A is a side view of an exemplary stereophonic speaker adapted for use with the portable bar.

FIG. 4 is a top view of the bar.

FIG. 5 is a top view of the bar without its hinged cover or handle and showing the speakers in their stored positions.

DETAILED DESCRIPTION OF THE PREFERRED EMBODIMENT

Referring to FIGS. 1 and 2 the portable bar 10 has an L-shaped case 12 with a top compartment 14 for storing liquor and mixer bottles, a protruding bottom compartment portion 16 extending beneath the top compartment 14 adapted for housing electronic equipment, and preferably a middle slot-like compartment 18 between the top and bottom compartments having an inside height dimension of at least one inch for storage of tape cassettes 20. A hinged cover 22 is attached to the case 12 in such a manner that it will swing shut to close off the interior of the portable bar. Side panels 23 protrude from the cover 22 toward the case 12 by the same distance that the bottom compartment portion 16 of the case protrudes forwardly from the top compartment 14. The side panels 23 extend downwardly preferably only to the upper surface of the bottom compartment portion 16. However a panel 24 preferably extends downwardly below the panels 23 to close off the front of the compartment portion 16 when the cover is shut. This shields the front of the electronic equipment housed in the bottom portion 16 and protects all switches, dials, meters and other controls which will normally be mounted on the front of the bottom compartment portion 16 for convenient access. One or more latches 26 is provided for securing the hinged cover 22 shut, and a handgrip 28 is provided at the top of the case 12 for transporting the portable bar.

Within the upper compartment 14 bottle straps 30, preferably made of an elastic material, are provided for holding bottles 32 as shown in FIG. 3. Similarly, implement straps 34 are attached to the interior of the hinged cover 22 for holding bar implements such as glasses 36, a stirrer 38 (FIG. 3), or other accessories such as an opener, jigger, cork screw, etc. (not shown). In addition, a playing card holder 40 may be conveniently attached to the cover 22. It is important that the bottles 32 are carried in their upright positions when the portable bar is transported by handle 28 and that they sit upright when the bar is opened and in use. Optimally the portable bar would be of appropriate dimensions to hold three bottles 32 and at least three glasses 36 as shown in FIG. 4.

The bottom compartment portion 16 is of a universal construction so as to house alternatively a variety of electronic equipment, such as a stereophonic radio receiver 42, cassette tape machine 44, and slidable storage drawer 46 for batteries, all shown in FIG. 1. It may alternatively be desirable that the lower compartment portion be equipped with different electronic equipment such as a television or digital clock or, for business purposes, a calculator or dictaphone (a dictaphone might also be incorporated into the cassette tape machine 44.)

The storage drawer 46 provides a place for mounting batteries 52 to power the electronic equipment, an electric power cord and other electronic accessories. In order to avoid exhausting the batteries too rapidly, a power supply 48 having an input power connector 50 as shown in FIGS. 3 and 5 is provided in a space behind the storage drawer 46. When connected to a standard alternating current electrical power outlet through connector 50 and a power cord, the power supply 48 converts the standard AC high voltage power to low voltage DC power and thereby acts as a substitute for the batteries 52. It can also be used to charge the batteries 52 in a conventional manner.

A pair of stereophonic speakers 52, one of which is shown in FIG. 3A, are preferably provided as part of the portable bar for use with the radio receiver 42 and tape machine 44. Depressions 56, shown in FIG. 3, formed in the protruding upper surface of the bottom compartment portion 16 and extending beneath the upper compartment 14 are provided for removably storing the speakers and associated lengths of speaker wire. This storage arrangement results in a substantially flat continuous upper surface across the width of the protruding bottom portion 16 of the portable bar when the speakers are stored. When the bar is opened, the speakers may be removed from their storage positions and hung by hooks 58 provided on the back of the speakers from hangers 60 mounted at the outermost upper corners of the bar case 12 and cover 22 respectively for forwardly directing the sound and providing needed stereo separation. Alternatively the speakers may simply be set elsewhere as permitted by the length of speaker wire available.

The portable bar provides a compact versatile entertainment center with a convenient and functional arrangement of compartments. It is significant that the disposition of the relatively heavy electronic equipment in the protruding bottom portion of the L-shaped case increases the stability of the bar by lowering its center of gravity and maximizing its base. The protruding bottom compartment portion 16 also provides the bar with the capacity and flexibility for compactly housing many different possible electronic devices and their accessories by providing mounting compartments having both upper and front exposed surfaces, thereby facilitating access to and control of the multiple devices. The provision of a mating cover with its depending protective panel 24 insures against damage to the electronic devices during travel by covering both the front and top of the protruding portion 16 of the L-shaped case.

The terms and expressions which have been employed in the foregoing abstract and specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. A portable bar adapted for mounting electronic equipment comprising:

a. a normally upright case including an upper compartment having means for holding a plurality of beverage bottles in upright positions and a bottom compartment disposed in fixed relation to said upper compartment to extend beneath said upper compartment and protrude perpendicularly forwardly therefrom so as to form a generally L-shaped case, said bottom compartment defining a space beneath said upper compartment, and having a protruding top and front, and being adapted to house said electronic equipment partially beneath said upper compartment to minimize the depth of said case;

b. openable cover means attached to the front of said case for simultaneously covering said upper compartment and said protruding top and front of said bottom compartment; and c. holding means on the interior of said cover means for detachably mounting bar implements.

2. The portable bar of claim 1 wherein said cover means comprises a unitary cover having side panels protruding therefrom toward said case a distance equal to the distance by which said bottom compartment protrudes from said upper compartment, said side panels extending downwardly at least to said protruding top of said bottom compartment, and a panel at the bottom of said cover for covering said front of said bottom compartment.

3. The portable bar of claim 1 wherein said case further includes an elongated slot-like compartment disposed between said upper and lower compartments adapted for storage of tape cassettes.

4. The portable bar of claim 1 including electronic sound-producing equipment mounted in said bottom compartment.

5. The portable bar of claim 4 including means defining a pair of depressions formed in said protruding top of said bottom compartment and a pair of speakers for use with said sound-producing equipment, each said speaker being of such size and shape as to fit matingly within a respective one of said depressions.

6. The portable bar of claim 5 including a pair of hangars mounted at the top of said case and cover respectively, said pair of speakers each including means removably attachable to said hangers for hanging said respective speakers therefrom.

7. The portable bar of claim 1 including handgrip means attached to the top of said case for carrying said portable bar.

* * * * *